US009395092B2

(12) United States Patent
Knight

(10) Patent No.: US 9,395,092 B2
(45) Date of Patent: Jul. 19, 2016

(54) FRONT MOUNTED AIR CIRCULATOR FOR AN OVEN

(71) Applicant: David B. Knight & Associates, Inc., Cape Girardeau, MO (US)

(72) Inventor: David B. Knight, Cape Girardeau, MO (US)

(73) Assignee: David B. Knight & Associates, Inc., Cape Giradeau ( * ) Notice: Subject to any disclaimer, the term of this patent is extended or adjusted under 35 U.S.C. 154(b) by 437 days.

(21) Appl. No.: 13/837,249

(22) Filed: Mar. 15, 2013

(65) Prior Publication Data

US 2014/0261372 A1 Sep. 18, 2014

(51) Int. Cl.
*F24C 15/32* (2006.01)
*F24B 1/20* (2006.01)

(52) U.S. Cl.
CPC ..... *F24C 15/322* (2013.01); *F24B 1/207* (2013.01)

(58) Field of Classification Search
CPC ..... F24C 15/322; F24B 1/207; A23N 7/005; F27D 1/1858
USPC ..... 126/19 R, 21 A
See application file for complete search history.

(56) References Cited

U.S. PATENT DOCUMENTS 1,274,276 A 7/1918 Kaslaitis
1,570,489 A 1/1926 Hill
2,147,801 A 2/1939 Scanlan
2,339,365 A 1/1944 Van Guilder
2,510,856 A 6/1950 Bettencourt
2,558,569 A 6/1951 Koch
2,833,201 A 5/1958 Simank
2,950,669 A 8/1960 Terry
2,956,497 A 10/1960 Bernstein
3,086,698 A 4/1963 Goldstein
3,326,201 A 6/1967 Murray
3,364,912 A 1/1968 Dills et al.
3,397,632 A 8/1968 Moler
3,474,225 A 10/1969 Leedy
3,477,360 A 11/1969 Raney
3,658,047 A 4/1972 Happel
3,665,840 A 5/1972 Horany
3,669,041 A 6/1972 Schworer
3,861,290 A 1/1975 Ringo
3,882,767 A 5/1975 Oyler et al.
4,010,729 A 3/1977 Egli
4,263,887 A 4/1981 Dowdall
4,287,870 A 9/1981 Johnson
4,300,523 A 11/1981 Robertson et al.
4,307,703 A 12/1981 Russo
4,344,358 A 8/1982 Maurer
4,457,292 A * 7/1984 Jorgensen ..... F24C 15/322 126/21 A
4,510,854 A 4/1985 Robertson
4,574,689 A 3/1986 Robertson
4,791,909 A 12/1988 Kalthoff
4,802,459 A 2/1989 McFadden et al.

(Continued)

*Primary Examiner* — Steven B McAllister
*Assistant Examiner* — Rabeeul Zuberi
(74) *Attorney, Agent, or Firm* — Senniger Powers LLP

(57) ABSTRACT

An oven for cooking food includes a housing having a front, a back, a top, a bottom, and a cooking chamber in the housing sized and shaped for receiving the food to be cooked. The cooking chamber has a front, a back, an upper portion, and a lower portion. A heating source heats air in the housing. An air mover is mounted generally at the front of the housing for moving heated air in the cooking chamber to produce a more uniform temperature and heat distribution in the cooking chamber.

21 Claims, 11 Drawing Sheets

(56) References Cited

U.S. PATENT DOCUMENTS

| | | | | | |
|---|---|---|---|---|---|
| 4,819,614 | A | | 4/1989 | Hitch | |
| 4,823,684 | A | | 4/1989 | Traeger et al. | |
| 5,154,159 | A | | 10/1992 | Knafelc et al. | |
| 5,158,066 | A | | 10/1992 | Dodgen | |
| 5,176,124 | A | | 1/1993 | Wrasse | |
| 5,478,985 | A | * | 12/1995 | Hoetzl et al. | 219/400 |
| 5,570,627 | A | | 11/1996 | Dahlstrom et al. | |
| 5,704,278 | A | | 1/1998 | Cross | |
| 5,711,209 | A | * | 1/1998 | Guines | 99/339 |
| 6,113,386 | A | | 9/2000 | Shannon et al. | |
| 6,810,792 | B1 | | 11/2004 | Knight | |
| 7,060,942 | B2 | | 6/2006 | Friedl et al. | |
| D534,755 | S | | 1/2007 | Knight | |
| 7,241,977 | B2 | | 7/2007 | Friedl et al. | |
| 7,409,904 | B2 | | 8/2008 | Blumel et al. | |
| 7,431,029 | B2 | * | 10/2008 | Kim et al. | 126/198 |
| 7,451,691 | B2 | | 11/2008 | Robertson | |
| 7,766,003 | B2 | | 8/2010 | Kim et al. | |
| 2003/0172919 | A1 | * | 9/2003 | Rabas et al. | 126/21 A |
| 2009/0056695 | A1 | | 3/2009 | Cosgrove | |
| 2010/0003387 | A1 | | 1/2010 | Knight | |
| 2011/0275023 | A1 | | 11/2011 | Knight | |
| 2012/0073557 | A1 | | 3/2012 | Knight | |

* cited by examiner

FRONT MOUNTED AIR CIRCULATOR FOR AN OVEN

FIELD OF THE INVENTION

The present invention generally relates to a heat and air circulator used in an oven.

BACKGROUND OF THE INVENTION

Space in a commercial kitchen is at a premium. Therefore, it is desirable to use the vertical space by making ovens tall in relation to their width and/or depth. However, the vertical elongation of the oven cooking chamber promotes heat stratification within the oven, and uneven cooking. A vertically elongate or vertically oriented oven is one in which the height of the oven cooking or warming chamber is greater than at least one of the horizontal dimensions of the cooking or warming chamber. Moreover, oven configurations promoting circulation of heat may in some circumstances be defeated by improper overloading of the oven with food that blocks the intended circulating flow.

One type of oven that may be vertically oriented in a barbecue oven. However, there are other ovens which are not used for barbeque cooking that can be vertically oriented that experience the heat stratification. Barbecuing is a cooking process that typically involves the cooking of foods by exposing them to relatively low temperature smoke for a number of hours. The structure used for barbecuing typically includes a heating or fire chamber, a cooking chamber and a conduit or flue through which smoke and heated combustion gases are transported from the fire chamber to the cooking chamber. Smoke and heat is produced by burning a smoke producing substance in the fire chamber such as wood, which is periodically replenished, until cooking is completed. The fire chamber is traditionally located to the side of the cooking chamber because grease often drips from the food being cooked. If the grease contacts the burning fuel, it could ignite. Other ovens besides barbecue ovens may also have remote or confined heating sources. In some cases, blowers or fans in the cooking chamber circulate the heated air and smoke from the fire chamber around the food to heat the food and impart a smokey flavor. However, these fans have not resolved the issue of heat stratification in the cooking chamber.

SUMMARY OF THE INVENTION

In one aspect of the present invention an oven for cooking food generally comprises a housing having a front, a back, a top, a bottom, and a cooking chamber in the housing sized and shaped for receiving the food to be cooked. The cooking chamber has a front, a back, an upper portion, and a lower portion. A heating source is provided for heating air in the housing. An air mover mounted generally at the front of the housing can move heated air in the cooking chamber. The air mover is arranged to move air rearward in the cooking chamber to produce turbulent air flow in the cooking chamber and thereby a more uniform temperature and heat distribution in the cooking chamber.

In another aspect of the present invention, a barbeque oven for cooking food generally comprises a housing having a cooking chamber sized and shaped for receiving the food to be cooked. The cooking chamber has a front, a back, an upper portion and a lower portion. A heating source can heat air in the housing is disposed in a fire chamber in the housing disposed below the cooking chamber. A wall in the housing is located between the cooking chamber and the fire chamber.

An air mover assembly is arranged in the housing to produce an air stream in the cooking chamber flowing across the cooking chamber and impinging on the wall creating a turbulent airflow in the cooking chamber.

In yet another aspect of the present invention, a barbeque oven for cooking food generally comprises a housing having a cooking chamber sized and shaped for receiving the food to be cooked. The housing has a front, a back, a top and opposite sides. A fire chamber is located in the housing in the housing. An air mover compartment in the housing has an air mover assembly arranged therein to produce an air stream in the cooking chamber flowing within the cooking chamber. The housing includes a first closure member on the front of the housing and movable between open and closed positions for accessing the cooking chamber, a second closure member on the front of the housing movable between open and closed positions for accessing the fire chamber, and a third closure member on the front of the housing and movable between open and closed positions for accessing the air mover assembly.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE DRAWINGS

Figure 1:
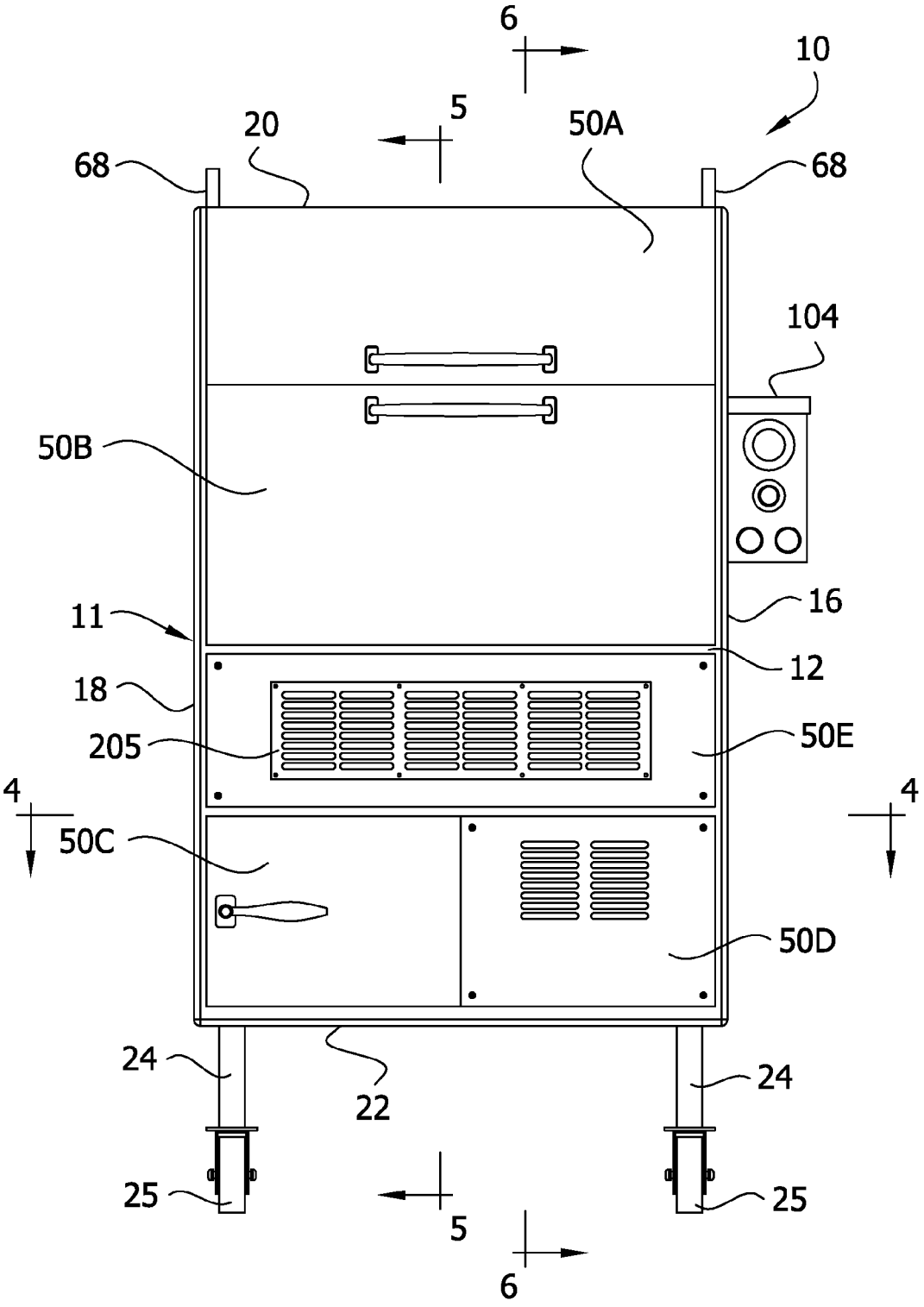
FIG. 1 is a front elevation of a barbecue oven.
Figure 2:
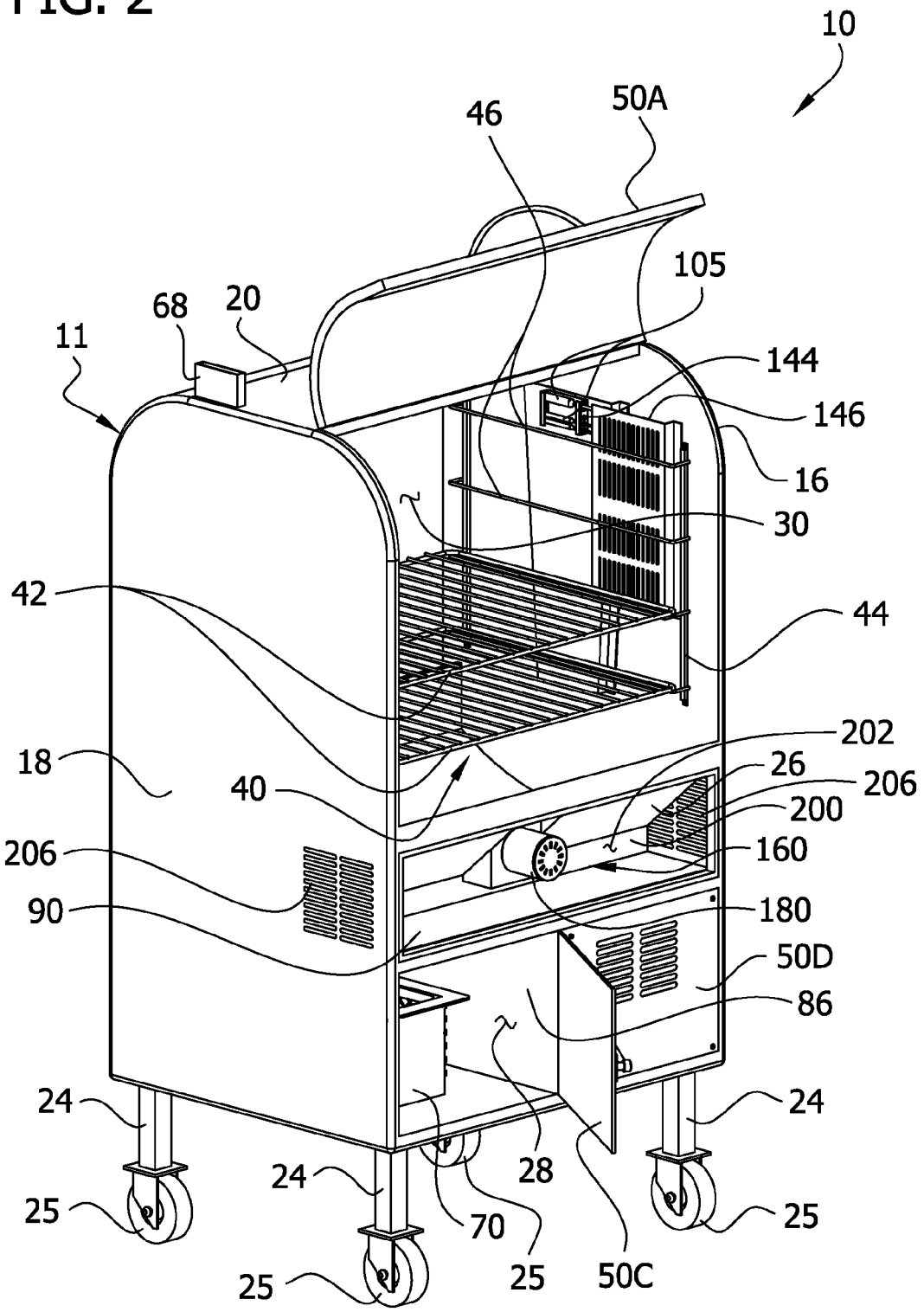
FIG. 2 is a perspective of the barbecue oven with doors and panels of the oven open and removed to show internal construction.
Figure 3:
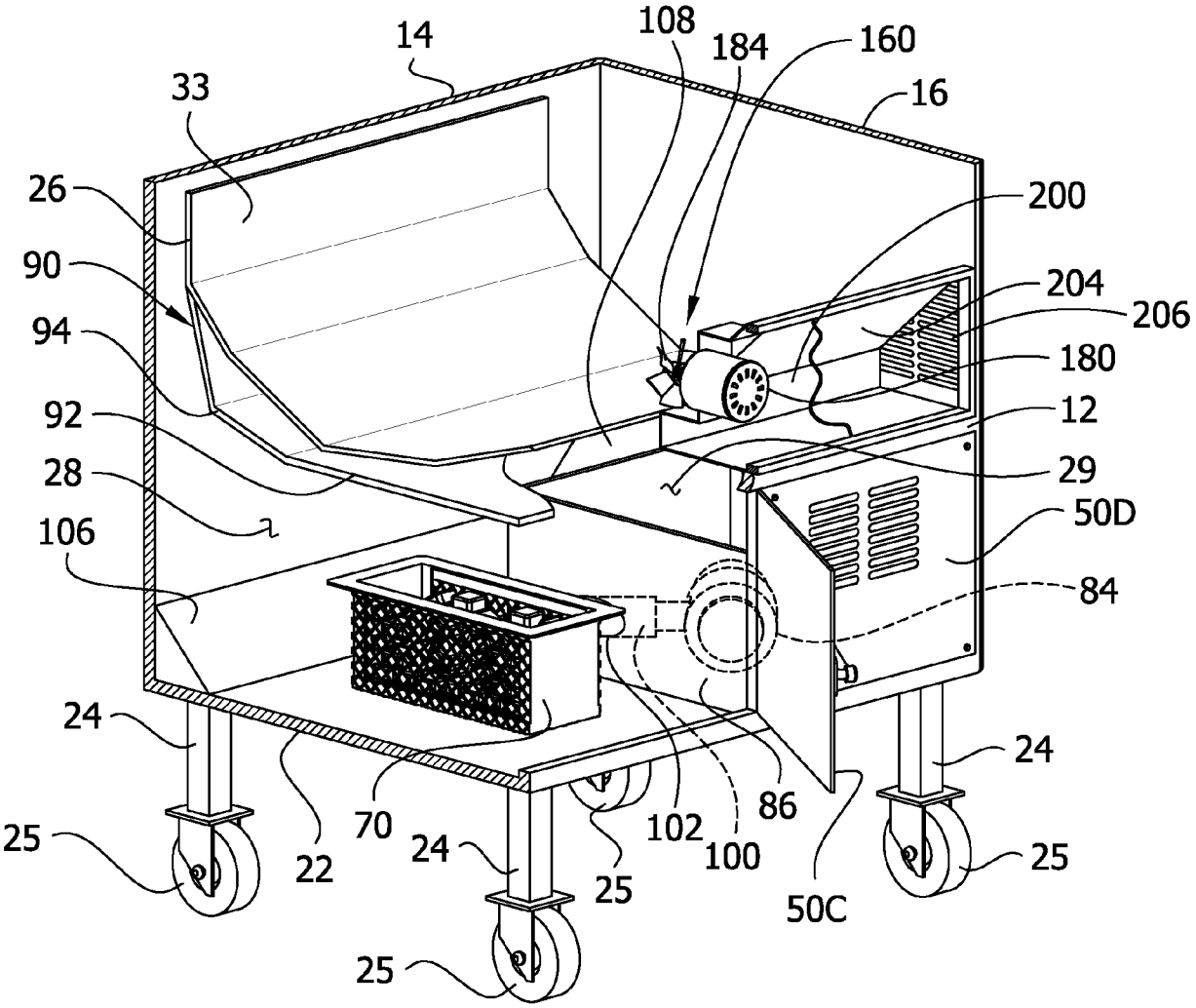
FIG. 3 is a perspective of the oven with portions broken away to show internal construction.

Referring now to the drawings and in particular to FIGS. 1-3, a barbecue oven that circulates heat and smoke around the food to be cooked is designated generally by reference numeral 10. For purposes of illustration, the invention will be described in conjunction with a barbecue oven, and in particular a barbecue oven of the type disclosed in co-assigned U.S. Pat. No. 6,810,792, the entire disclosure of which is incorporated herein by reference. However, the invention is not to be limited to this specific use, as it is instead intended that the invention be used in any application in which circulation of heated air in an oven is required. The oven 10 includes a housing, indicated generally at 11, which comprises a front wall 12, a back wall 14, side walls 16 and 18, a top 20 and a bottom 22. The front, back and side walls 12, 14, 16, 18, constitute wall members which together form vertical walls of the housing 11. The number of wall members forming the vertical wall may be other than described without departing from the scope of the present invention.

The housing 11 is supported by legs 24 that include wheels 25 to facilitate transport of the oven 10. The housing 11 is suitably constructed of heat resistant materials such as stainless steel. However, other metals or porcelain coated materials suitable for use in cooking ovens can also be utilized. The oven 10 may also include insulation material in various parts thereof to maintain temperatures in the oven and to protect users from heat generated by burning fuel in the oven. Insulation may comprise a double-wall construction of the walls 12, 14, 16, 18, 20 and 22 thereof. The double-wall structure may include insulating material between the walls, such as high-temperature mineral wool or other non-combustible material.

The interior of the housing 11 is divided up into a fire chamber 28, a burner chamber 29 and a cooking chamber 30. In one embodiment, the cook chamber bottom wall 26 extends between the opposite side walls 16, 18 along the interior width of the oven 10 and extends from the front wall 12 to near the back wall 14 along the interior depth of the oven. The bottom of the cooking chamber 30 is defined by a wall 26 that is generally curved from front to back in the housing 11. More specifically, the wall 26 includes a number of flat sections connected by bends that give the wall 26 its roughly curved shape. A back portion 33 of the wall 26 extends upward to form a tapered delivery duct 32 having a throat 34 between the cook chamber bottom wall and the back wall 14 of the oven 10 (see, FIG. 5). The throat 34 also defines an outlet of the duct 32 and of the fire chamber 28 into the cooking chamber, and accelerates heated air and smoke as it enters the cooking chamber.

Referring to FIG. 2, a food support, indicated generally at 40, is located within the cooking chamber 30. In the illustrated embodiment, the food support 40 includes a plurality of racks 42 (two upper racks being removed in FIG. 2 for clarity) supported on brackets 44 that are secured to the sidewalls 16, 18 of the housing 11. Each bracket 44 includes vertically spaced rails 46, each aligned with a corresponding one of the rails on the bracket 44 on the opposite side wall (16 or 18). The rails of each pair of aligned rails receive opposite edge margins of one of the racks 42 to support the rack in the cooking chamber 30. In the illustrated embodiment, the rails 46 are collectively considered to be a "food support mount". Generally speaking, the food support 40 may have various configurations (not shown), including rotisserie-style racks, rotating spits, shelves, or baskets without departing from the scope of the invention. The food support mount would be appropriate for the particular food support being used.

A pair of upper lids or doors 50A, 50B (shown in the open position in FIG. 2) makes up a portion of the front wall 12 and the top 20 of the housing 11 and provides access to the cooking chamber 30. The doors 50A, 50B (broadly, "closure members") may have a heat resistant glass window (not shown) located therein to allow the user to monitor the food product being cooked without having to open the door. Also located on the doors 50A, 50B may be a thermometer (not shown) that indicates the temperature inside the oven 10 to aid in regulating the fire in the fire chamber 28. During operation of the oven 10, the doors 50A, 50B are typically in a closed position except when inserting food into or retrieving food from the oven 10. A lower door 50C (broadly, "a closure member") is located at a lower portion of the front wall 12. The lower door 50C is movable between an open position to provide access to the fire chamber 28, and a closed position. The fire chamber door 50C opens in a direction forward of the front wall 12, as do cooking chamber doors 50A, 50B. By having the fire chamber door 50C on the front of the oven 10, it permits the oven to be placed closer to other equipment or walls on either side of the oven. Thus, when an operator needs to add more fuel to oven 10, the operator need only gain access to the front of the oven. A panel 50D (broadly, "a closure member") is mounted to the front 12 of the oven 10 by suitable fasteners such as screws (FIG. 1). The panel 50D is movable between open (in this can be being removed from the housing) and closed positions to provide front access to the burner chamber 29. A panel 50E (broadly, "a closure member") is also mounted on the front 12 of the oven 10 by suitable fasteners such as screws. Panel 50E is movable between open (in this case by being removed from the housing) and closed positions to provide front access to a heat and air circulator 160 mounted at the front of the oven 10. Access to all interior compartments of the oven 10 can be acquired from the front of the oven. Other arrangements of the doors and panels 50 (including those which do not provide front access) may be used within the scope of the present invention.

Figure 5:
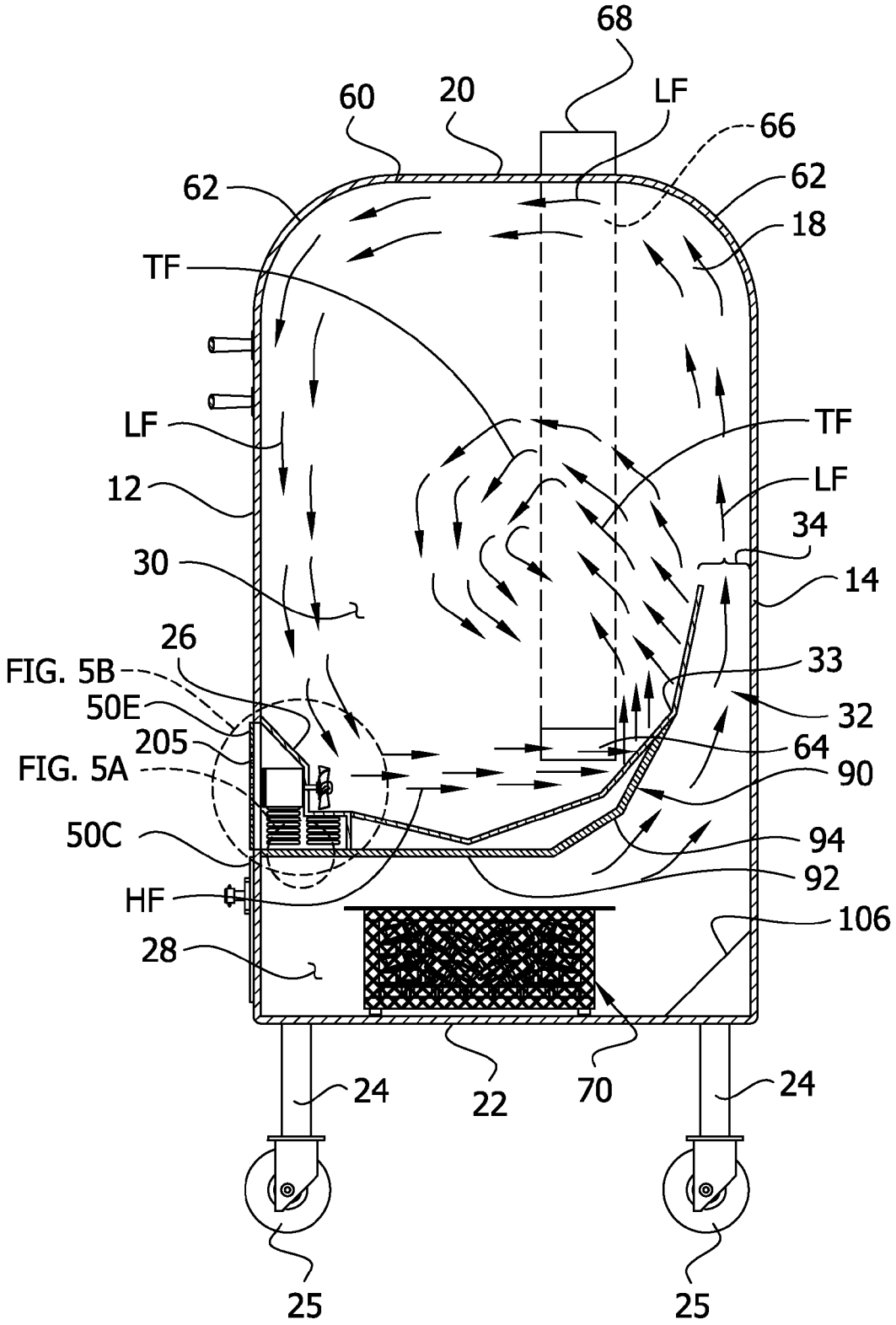
FIG. 5 is a cross-section of the oven taken through line 5-5 in FIG. 1 with internal components in the upper portion of the oven removed illustrating a flow path of heated air and smoke in the oven.

As configured, the top 20 of the housing 11 has a generally flat section 60 and curved ends 62 joining the front and back walls 12, 14 to the top of the housing (FIG. 5). The curved shape of ends 62 give the top of the enclosure 11 a generally concave shape opening downward toward the cooking chamber 30. The curved shape of the transition between the top 20 and front and back walls 12, 14 also influences the circulation of heated air and smoke within the oven 10 by reducing the accumulation of stagnant pockets of air in the cooking chamber as will be explained in greater detail below. It will be appreciated that the curved shapes of the illustrated oven are not present in all vertically oriented ovens. However, in situations where the oven is loaded with more than recommended amounts of food, air stagnation and thermal stratification could occur in spite of the beneficial construction of the housing 11 and firewall 26.

Smoke may exit the cooking chamber 30 through one or more portals 64 located in the sidewalls 16, 18 of the housing. The portals 64 (only one illustrated in FIG. 5) serve as openings into exhaust ducts 66 contained within the sidewalls 16, 18. Desirably, the portals 64 are located in the sidewalls 16, 18 so that the portals are below the bottom most portion of the food rack 40. This location of the portals 64 facilitates removal of smoke in an amount and rate which promotes circulation of smoke and maintenance of smoldering solid fuel in the fire chamber 28. Thus, food in the oven is properly flavored by the smoke without being over exposed to the smoke. The exhaust ducts 66 desirably have a bottom surface (not shown) that slopes upward from the interior surface of the sidewall to the outward surface of the exhaust duct so that any grease splattering into the portals 64 is discouraged from accumulating in the ducts. The exhaust ducts 66 are suitably about 4 inches wide and about ¾ of an inch deep and form a conduit leading to exhaust stacks 68 near the top 20 of the oven 10 which can be open to the atmosphere or connected to a suitable chimney. The exhaust stacks 68 extend from the housing 11 above the sidewalls 16, 18 so as to not interfere with the door 50A. Ambient heat in the cooking chamber 30 is transferred through the side wall 16, 18 to the confined space in the exhaust duct 66 to aid in transporting the smoke. When heated, the exhaust ducts 66 transport heat and smoke through the exhaust stacks 68 to the atmosphere, promoting the circulation of the smoke and heat within the cooking chamber 30. Other means for venting smoke from the cooking chamber 30 are contemplated without departing from the scope of the invention.

Figure 4:
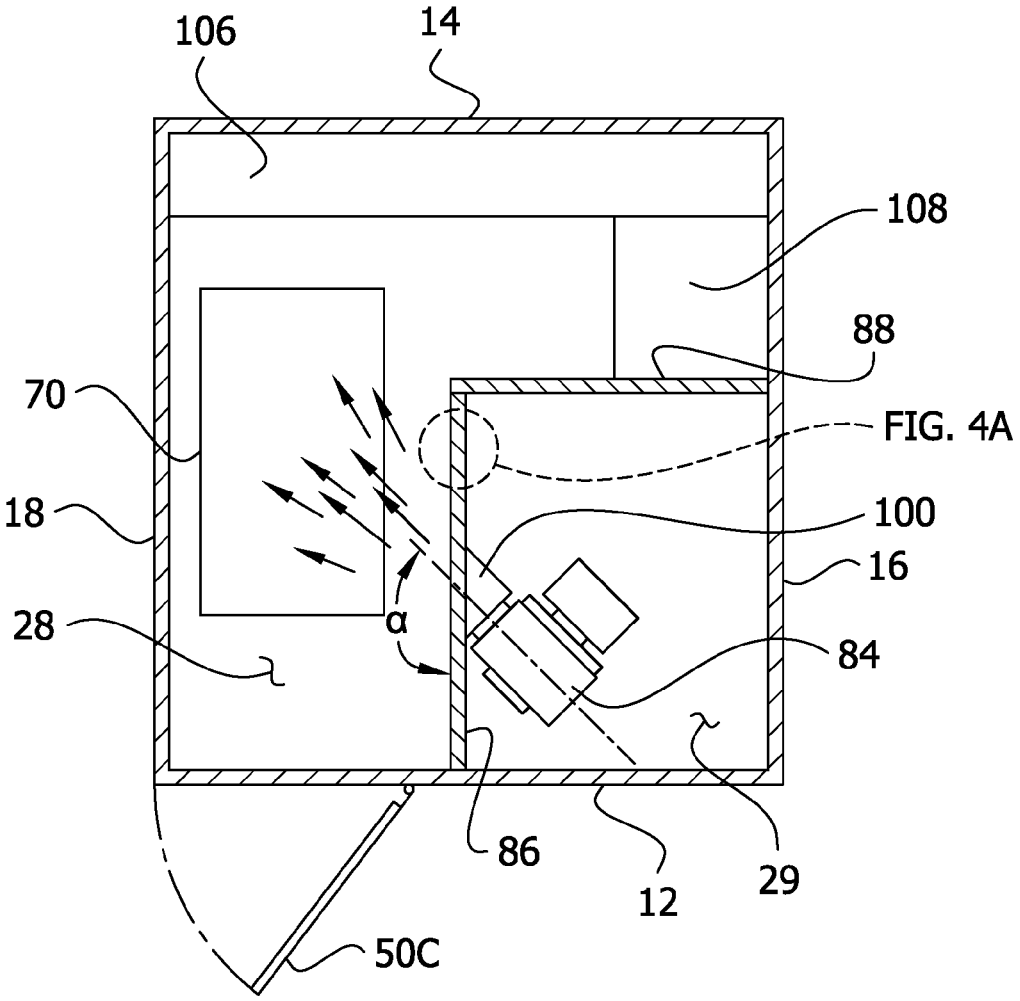
FIG. 4 is a cross-section of the oven taken through line 4-4 in FIG. 1 illustrating heat flow from a burner of the oven.

The fire chamber 28 contains a fuel vessel, broadly a heat source, generally indicated at 70. In the illustrated embodiment, the fuel vessel 70 is a solid fuel vessel that holds combustible material such as wood logs, wood chips, lump charcoal, compressed charcoal, wood pellets, and the like. The fuel vessel 70 may also contain a relatively small quantity of a smoke producing material such as hickory wood. It is also to be understood that no smoke producing material or vessel containing such material need be present within the scope of the present invention. The vessel 70 sits on the bottom 22 of the housing 11 to maintain the vessel in its proper position in the fire chamber 28. As best seen in FIG. 4, the vessel 70 is suitably elongated in shape and during use in the oven 10 extends longitudinally in the depthwise direction of the oven.

Figure 4A:
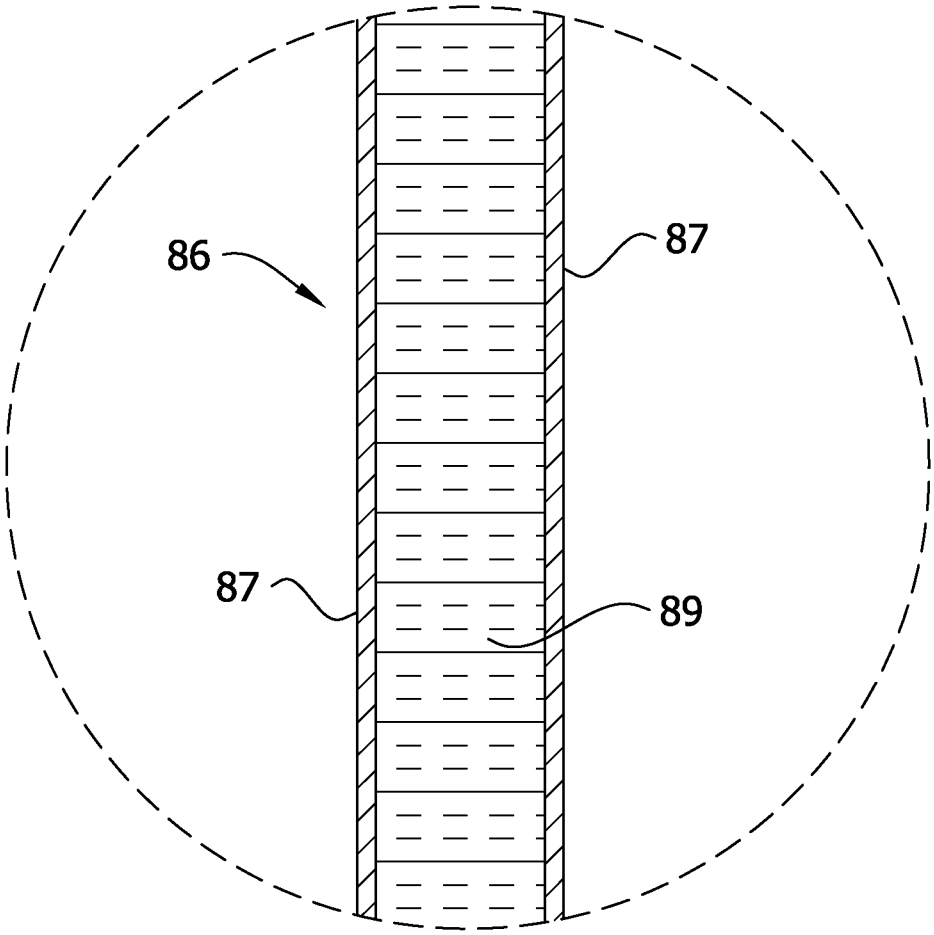
FIG. 4A is an enlarged fragmentary cross section of a side firebox wall of the oven taken as indicated in FIG. 4.

Referring to FIG. 4, a side firebox wall 86 extends rearwardly from the front wall 12 generally parallel to the side walls 16, 18. A rear firebox wall 88 extends from a back end of the side firebox wall 86 to the side wall 16, generally parallel to the front and back walls 12, 14. The side and rear firebox walls 86, 88 may have a double-wall construction including wall members 87 and insulation material 89 between the wall members to maintain temperatures in the fire chamber 28 and to protect users and other components and compartments of the oven 10 from heat generated by burning fuel in the fire chamber (FIG. 4A). The insulation material 89 may be formed from high-temperature mineral wool or other non-combustible material.

Figure 6:
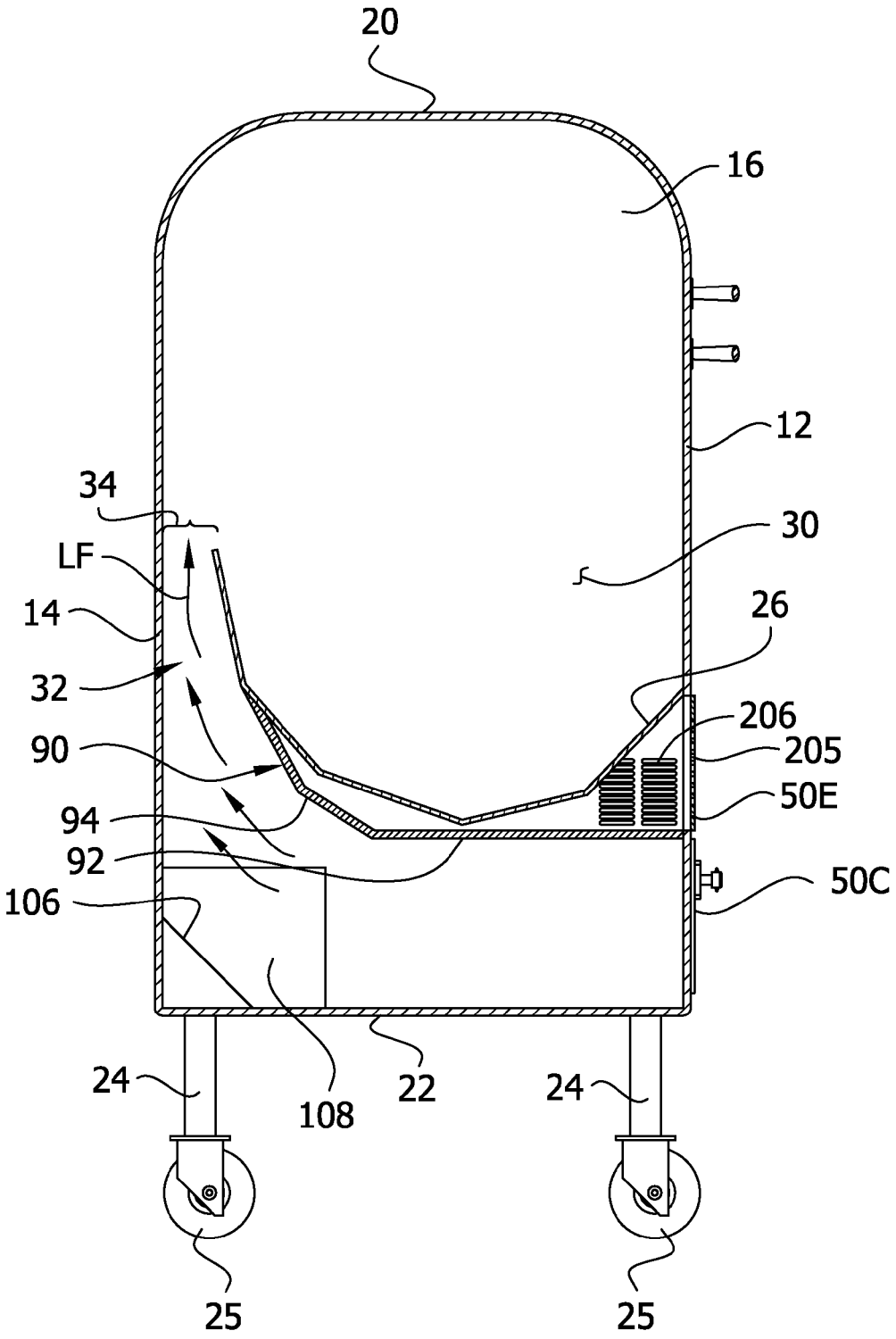
FIG. 6 is a cross-section of the oven taken through line 6-6 in FIG. 1 and illustrating a laminar airflow.

Referring to FIGS. 3, 5 and 6, a top firebox wall 90 (broadly, "a heat shield") is disposed above the side and rear firebox walls 86, 88. In the illustrated embodiment, the top firebox wall 90 extends between the opposite side walls 16, 18 along an interior width of the oven 10. The side firebox wall 86 separates the fire chamber 28 from the burner chamber 29. The fire chamber 28, the burner chamber 29, or the fire chamber and burner chamber 29 together may be broadly considered to be "a heating source chamber." The top firebox wall 90 also extends from the front wall 12 to near the back wall 14 along an interior depth of the oven. The top firebox wall 90 has a horizontal portion 92 extending from the front wall 12 that covers the burner chamber 29 and a substantial portion of the fire chamber 28, and a generally angled portion 94 extending rearward and upward from the horizontal portion near the back wall 14. The horizontal portion 92 is generally parallel to the floor of the fire chamber 28. The angled portion 94 is formed with two upward bends giving it a generally arcuate configuration. The angled portion 94 terminates at a cook chamber bottom wall 26 disposed above the top firebox wall 90. The top firebox wall and side and rear firebox walls 86, 88 are secured to each other and to the front wall 12 and side walls 16, 18 of the housing 11 such as by welding. However, the firebox walls 86, 88, 90 can be secured to the housing 11 and each other using suitable brackets and fasteners (not shown) without departing from the scope of the invention. In particular, because the fire chamber 28 is located below the cooking chamber 30, insulation from radiative heat from the bottom of the cooking chamber to the food in the cooking chamber is needed. This can be provided by the top firebox wall 90.

Figure 5A:
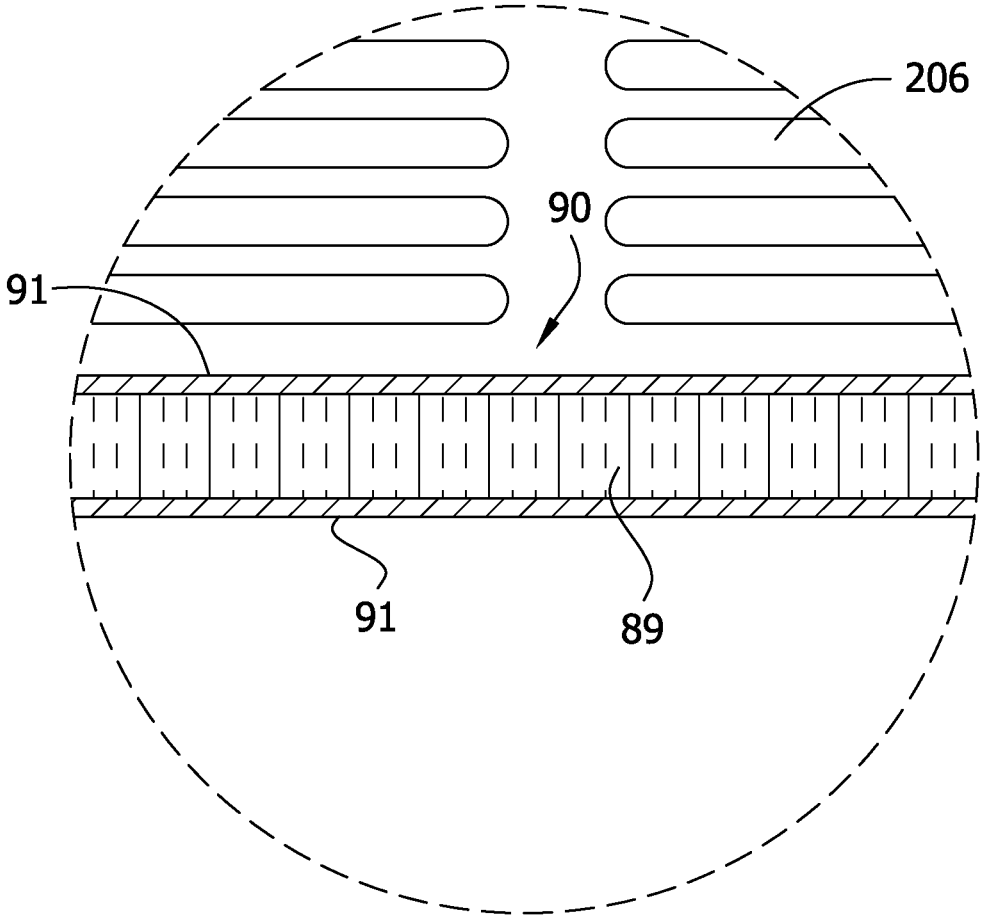
FIG. 5A is an enlarged fragmentary cross section of a top firebox wall of the oven taken as indicated in FIG. 5.

The top firebox wall, like the side and rear firebox walls 86, 88, has a double-wall construction including wall members 91 and insulation material 89 between the wall members (FIG. 5A). The firebox walls 86, 88, 90 are spaced from other walls of the oven to permit expansion and contraction and to insulate the fire chamber 28. It will be appreciated that the firebox walls 86, 88, 90, fire chamber 28 and burner chamber 29 may have other configurations within the scope of the present invention. Also, all or a portion of the top firebox wall 90 may be omitted. If the top firebox wall 90 is omitted, the cooking chamber bottom wall 26 may function as a firebox wall. Accordingly, the cooking chamber bottom wall may also have a double-wall construction for insulation as illustrated for the top firebox wall 90. In the illustrated embodiment, the back portion 33 of the bottom wall 26 is not covered by the top firebox wall 90 and can be subjected to substantial heating by smoke and air passing out of the duct 32.

Referring to FIGS. 5 and 6, the cook chamber bottom wall 26 is disposed above the top firebox wall 90 and defines a floor of a cooking chamber 30 of the oven 10. Together, the cook chamber bottom wall 26 and top firebox wall 90 define a heat flow regulating wall. The oven 10 has a generally vertical orientation, meaning that the vertical dimension of the cooking chamber 30 is greater than at least one of its horizontal dimensions. Moreover, the cooking chamber 30 is located above the fire chamber 28. The delivery duct 32 is defined by the back portion 33 of the cook chamber bottom wall 26, angled portion 94 of top firebox wall 90, a portion of the back wall 14 generally opposing the rear portion of the cook chamber bottom wall and angled portion of the top firebox wall, and sections of the side walls 16, 18 extending between the rear portions of the firebox wall and top firebox wall and opposing portions of the back wall. A first end or inlet of the delivery duct 32 is located in a horizontal plane between the lowest point of the top firebox wall 90 and the back wall 14. Heated air and smoke from the fire chamber 28 pass through the throat 34 to the cooking chamber 30. One or more flanges (not shown) extending from the cook chamber bottom wall 26 to the back wall 14 may secure the cook chamber bottom wall to the back wall without substantially blocking the throat 34. The top firebox wall 90 and cook chamber bottom wall 26 are fixed to the front wall 12 and the side walls 16, 18 of the housing 11 such as by welding. However, the top firebox wall 90 and cook chamber bottom wall 26 can be fixed to the housing 11 using suitable brackets and fasteners (not shown) without departing from the scope of the invention. It will be appreciated that the cook chamber bottom wall 26 may have other configurations within the scope of the present invention. It will also be understood that if the top firebox wall 90 is omitted, the cook chamber bottom wall 26 will suitably define a portion of the delivery duct 32.

A burner 84 (broadly, "a heat source") is located in the burner chamber 29. In the illustrated embodiment, the burner 84 is a gas-fired power burner configured to burn natural gas, LP gas, or other fuel to provide a heat source. A burner tube 100 is attached to an outlet of the burner 84 and extends to a hole 102 in the side firebox wall 86. Because the burner tube 100 intersects the wall 86 at an angle, the hole 102 is an ellipse rather than a circle. The elliptical hole 102 is elongated in the lengthwise direction of the vessel 70 (i.e., in the front-to-back direction of the oven 10). The tube 100 is mounted in a suitable manner on the side firebox wall 86, such as by a bracket (not shown). The tube 100 opens through the side firebox wall 86 at an oblique angle so that the tube is oriented relative to the fire chamber 28 at an oblique angle. In the illustrated embodiment, the tube 100 is oriented relative to the side firebox wall 86 at an angle $\alpha$ of about 135 degrees measured between the side firebox wall and a longitudinal axis of the tube. Because the vessel 70 ideally extends substantially parallel to the side firebox wall 86, the tube 100 is oriented at the same angle with respect to the vessel as the side firebox wall. It is understood however that the vessel 70 may be disposed in the fire chamber 28 at an angle to the side firebox wall 86 such that the orientation of the tube 100 and vessel is different from the orientation of the tube and the side firebox wall. The tube 100 may be oriented at other angles relative to the side firebox wall 86, including orthogonally to the vessel within the scope of the present invention. It will be understood that the burner could be omitted, or replaced by a blower that did not produce heat. The burner 84 may also be broadly considered an air mover. Other heat sources, including electric heat sources may be used within the scope of the present invention.

The combination of the front-mounted fire chamber door 50C and the angled burner tube 100 attached to the burner 84 produces an upward thrust in the heat path from the fire chamber 28 to the cooking chamber 30. The upward thrust is also due in part to the delivery duct 32 and angled plates 106, 108 welded to the bottom 22, back wall 14 and side wall 16 of the oven 10. The upward thrust generates a laminar airflow LF in the cooking chamber 30 (FIG. 5). The laminar airflow LF originates in the duct 32 and passes through the throat 34 into the cooking chamber 30. The laminar airflow LF moves in an upward direction along the interior of the back wall 14 of the oven 10 and follows the inner surface as it curves along the curved ends 62 of the top 20 of the housing 11 and back down the front wall 12 to the cooking chamber bottom wall 26.

The upward thrust of heated air also impinges on bottom surfaces of the top firebox wall 90 and cooking chamber bottom wall 26. Because a section of the back portion 33 of the cooking chamber bottom wall 26 is not covered by the top firebox wall 90, this section of the back portion is heated to a higher temperature than the remainder of the cooking chamber bottom wall. The heated air increases the thermal energy of the cooking chamber bottom wall 26. Therefore, this section of the back portion 33 of the cooking chamber bottom wall 26 has greater thermal energy than the remainder of the cooking chamber bottom wall. As will be explained in greater detail below, a fan 160 releases the thermal energy in the back portion 33 of the cooking chamber bottom wall 26 to distribute heat in the cooking chamber 30. It will be understood that if the top firebox wall 90 is omitted, a larger section of the back portion 33 of the cooking chamber bottom wall 26 will be heated to the higher temperature as more of the cooking chamber bottom wall will be subject to direct exposure to the heated air from the fire chamber 28. As illustrated, at least the top three segments, as defined by the bends, would be heated to the higher temperature if the top firebox wall was omitted. Of course, the bottom wall 26 could be in other embodiments selectively insulated to reduce the heat transmitted to the portion of the bottom wall facing the cooking chamber 30.

Referring to FIGS. 3, 5, 5B and 5C, the fan (broadly, "air mover") is generally indicated at 160. The fan helps to distribute the heated air and smoke within the cooking chamber 30 to produce a more uniform temperature and heat distribution in the cooking chamber. The fan 160 is mounted generally at a front of the oven 10 below the lower door 50B. In the illustrated embodiment, the fan 160 is mounted generally at a center of the oven 10 between side walls 16, 18, and is aligned with a lower portion of the cooking chamber 30. The fan 160 includes a fan motor 180, a driveshaft 182 operatively connected to the motor for rotation about its axis, and rotor 184 including blades secured to the driveshaft. In the illustrated embodiment, the fan motor 180 is electrically powered, although other types of motors are within the scope of the invention.

Figure 5B:
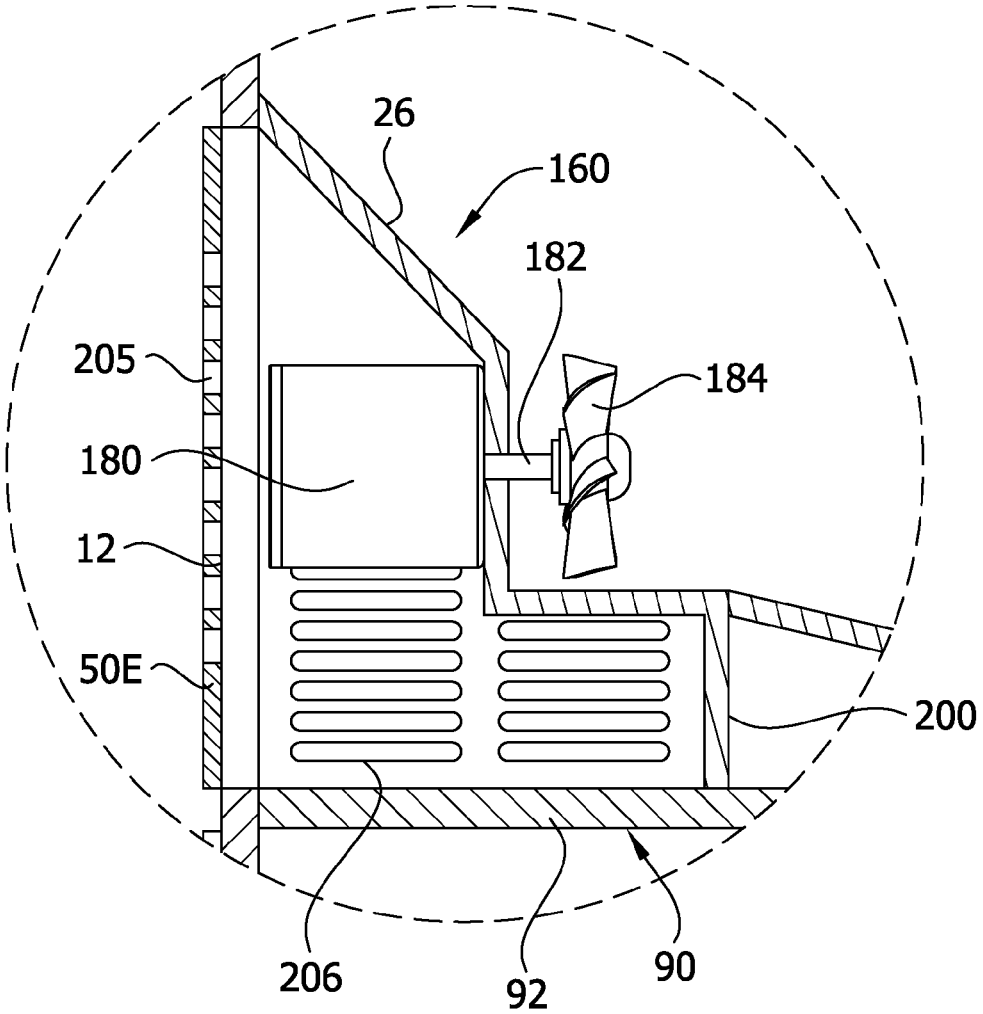
FIG. 5B is an enlarged fragmentary cross section of a fan compartment of the oven taken as indicated in FIG. 5.
Figure 5C:
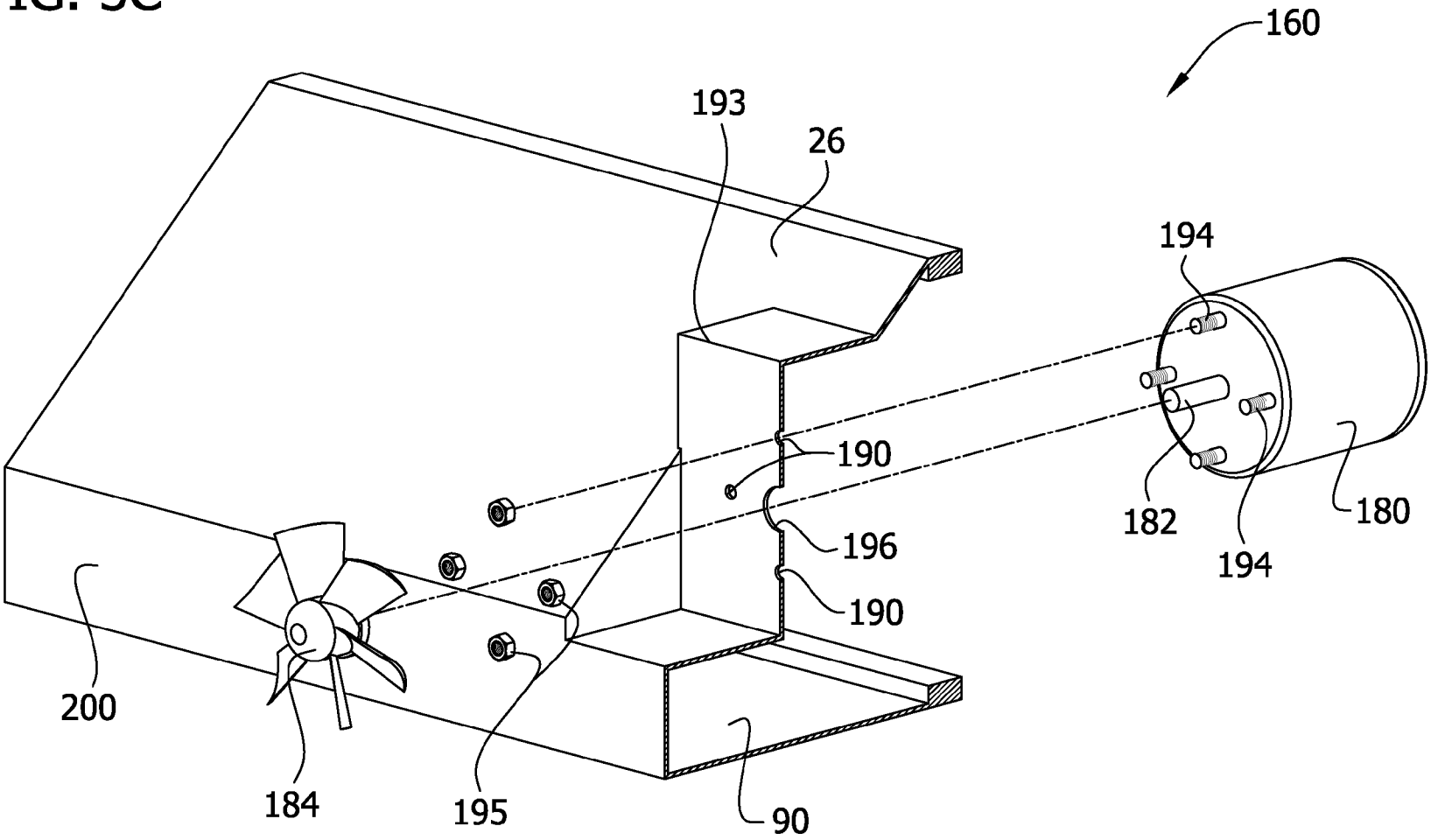
FIG. 5C is an exploded perspective of an air circulator of the oven.

The fan motor 180 is mounted on the cooking chamber bottom wall 26 (FIGS. 5B and 5C). Threaded fasteners 194 on the motor housing are received through openings 190 in a vertical surface of a bump out 193 of the wall 26 (FIG. 5C). Nuts 194 are screwed on to the threaded fasteners 194 on the inner surface of the bump out 193 to secure the fan motor 180 in place. The driveshaft 182 extends through a clearance opening 196 in the bottom wall and into the cooking chamber 30 so that the rotor 184 is disposed within the cooking chamber. Other configurations and arrangements of the fan 160 are within the scope of the invention. For example, the fan 160 may be located so that rotor 184 is disposed at other locations within the cooking chamber 30. There may be more than one fan.

Figure 5D:
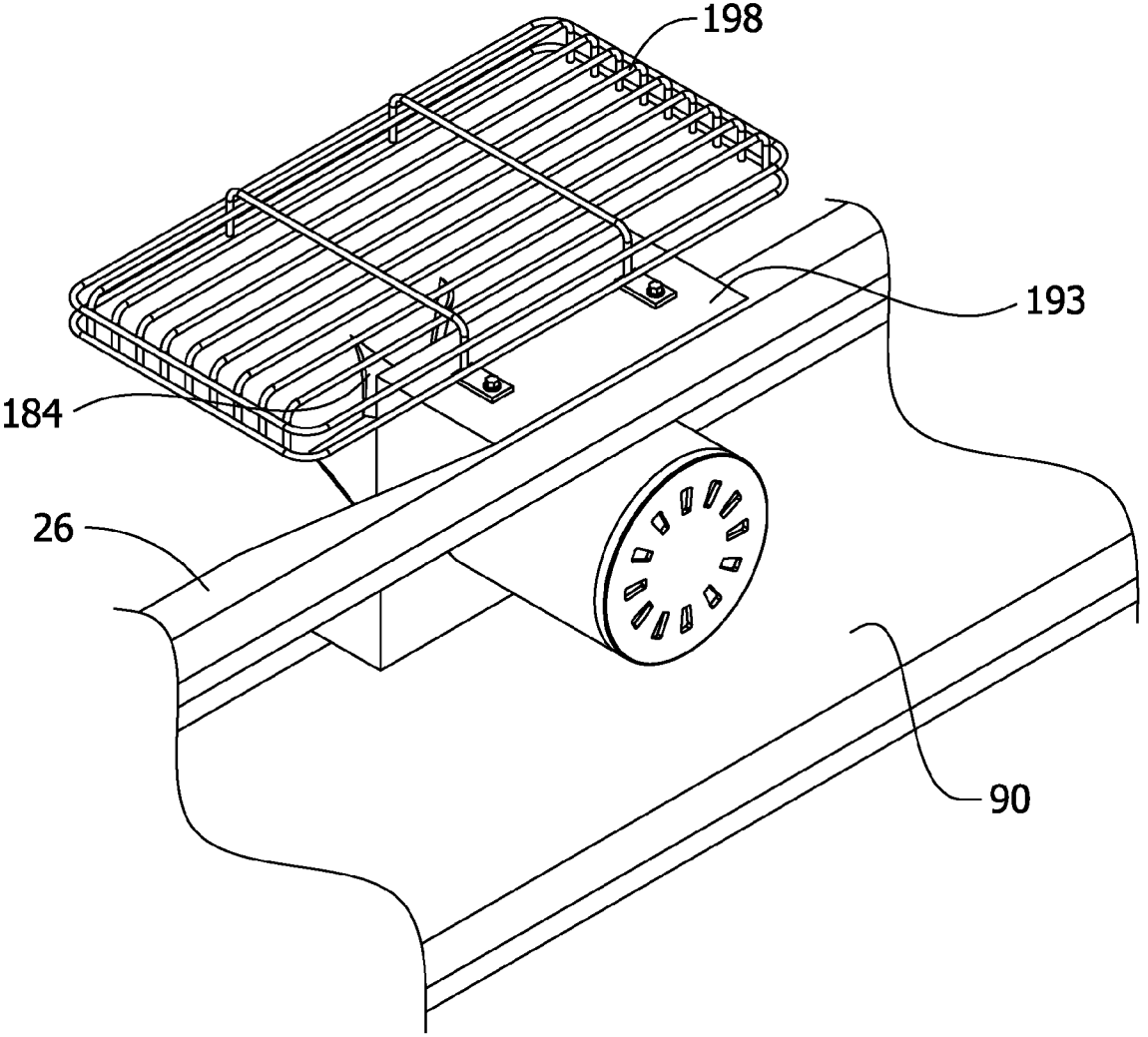
FIG. 5D is an enlarged fragmentary perspective of the air circulator with a safety shield mounted in the oven.

The motor 180 of the fan 160 is mounted outside of the cooking chamber 30 in a sealed manner to prevent heated air and smoke from leaking out of the cooking chamber at the location where the motor is mounted. The attached end of the motor 180 is in generally flush, tight engagement with the exterior surface of the vertical wall of the bump out 193 to prevent air and smoke from leaking out of the cooking chamber 30 between the vertical wall and the motor. A heat-resistant sealant may be applied at the juncture of the motor 180 and the bottom wall 26 to further inhibit air and smoke leakage. Other ways of mounting the fan 160 or other type of air mover on the oven 10 are within the scope of the invention. A safety shield or grill 198 may be mounted on the bump out 193 of the cooking chamber bottom wall 26 and disposed over the rotor 184 to protect users from being injured by the fan blades and prevent heavier items from falling on the rotor (FIG. 5D).

A fan wall 200 extends downward from the cooking chamber bottom wall 26 to the firewall 90. Panel 50E, side walls 16, 18, cooking chamber bottom wall 26, fan wall 200 and firewall 90 combine to form a fan compartment 202 that houses the circulating fan motor 180. An interior of the fan compartment 202 may contain insulation 204 (FIG. 3) to insulate the fan motor 180 from the fire chamber 28 and cooking chamber 30. A vent 205 in the panel 50E allows the fan 160 to draw in air from the surrounding environment to cool the fan 160. In one embodiment, the fan motor 180 include a centrifugal fan element draws air into the fan compartment 202 through the vent 205 and forces air to the sides of the compartment and out of vents 206 in respective sides 16, 18 of the housing. This circulation of air through the fan compartment 202 keeps the motor 180 cooler. The fan compartment 202 is located entirely within the profile of the housing 11 and so does not require any extra space than would otherwise be occupied by the housing. Therefore, the footprint of the oven 10 is unaffected by the provision of the fan 160. Relatively few additional parts are required, because the bottom wall 26 is constructed with the bump out for mounting the fan 160.

As may be seen in FIG. 5, the fan compartment 202 is formed as a function of the curvature of the bottom wall 26 of the cooking chamber 30 that is provided to promote circulation of air and smoke in the cooking chamber. Thus, the larger the size of the oven, the more space will be provided for the fan compartment because of the curvature of the bottom wall. Ovens having larger cooking chambers will require larger fans. A larger fan will be readily accommodated in the larger fan compartment and the overall footprint of the oven will be unaffected by the size of the fan needed. Access to the fan through the panel 50E allows for easy maintenance, cleaning and repair. For example, if the rotor 184 needs to be replaced, the front doors 50A, 50B can be opened, the grill 198 removed and the rotor replaced. No substantial disassembly of the oven is required and virtually no access to the rear of the oven is necessary. Thus, there is no need to disconnect the oven from power and/or gas sources and move it away from the wall. As previously stated herein, the doors 50A, 50B providing access to the cooking chamber 30, the door 50C to the fire chamber 28, the removable panel 50D to the burner 29 and the panel 50E providing access to the fan compartment 202 are all located on the front of the oven 10. All access needed for the oven 10 is provided at the front so that the oven can be placed close to the wall in a restaurant without need to move it for maintenance. Thus, the oven 10 has small spaced requirements in use.

A thermostat 104, broadly a controller, may be mounted on the housing 11 and connected with the burner 84 by electrical wiring and controls (not shown) in a conventional manner. The thermostat 104 is adjusted to maintain a desired temperature within the cooking chamber 30 by controlling the current flowing to the burner 84. Thermocouples 105 (see FIG. 2), broadly temperature sensors, are secured within the cooking chamber 30 and provide temperature input to the thermostat 104. For example and without limitation, the thermocouples may be part of a primary thermostat (e.g., thermostat 104), a secondary thermostat, a thermometer and an upper limit control switch thermostat. The thermostat 104 may be a conventional thermostat such as a Robertshaw 5300-17E and may use simple logic or may receive input from thermocouples and use staged or sequenced logic. When the desired temperature is achieved, (suitably between about 200 degrees F. and about 250 degrees F., the thermostat 104 automatically turns off the burner 84. When the temperature in the cooking chamber 30 falls sufficiently below the desired temperature, such as to a range between about 5 F degrees and about 10 F degrees, the thermostat 104 reenergizes the burner 84, thus reestablishing combustion in the solid fuel in the vessel 70 and restoring the desired temperature. In this manner, the thermostat 104 controls the burner 84 to restore combustion of the fuel and maintain the air temperature within the oven 10 within a predetermined range. Also, the size and location of the portals 64 leading to exhaust ducts at the bottom of the cooking chamber 30 help to control the flow of air in the cooking chamber. Smoke is exhausted in an amount and at a rate which promotes circulation of the smoke in the cooking chamber and maintenance of the fuel in the fire chamber 28. This provides additional control over the temperature in the cooking chamber 30.

In the illustrated embodiment, the thermocouples 105 for regulating the thermostat 104 (FIG. 1) are mounted on the side wall 16 at a top of the cooking chamber 30 (FIG. 2). The thermocouples 105 are secured to a mount 144, which is secured to the side wall 16. The mount 144 includes openings for receiving the respective thermocouples. The thermocouples 105 may be secured within the cooking chamber at other locations within the scope of the present invention. Further, a protective screen 146 covers thermocouple tubes and connectors (not shown) that connect the thermocouples 105 to the thermostat. The screen 146 protects the thermocouple tubes and connectors while also allowing the ambient air of the cooking chamber 30 to flow around the tubes and connectors for more accurate measurements.

In use, the fan 160 circulates heated air and smoke within the cooking chamber to reduce heat stratification and produce a more uniform temperature and heat distribution in the cooking chamber 30. With the fan 160 powered on during cooking, the fan blows heated air and smoke along a generally horizontal air stream path HF in the direction of the back portion 33 of the cooking chamber bottom wall 26. The heated air moving along airflow path HF impinges upon the back portion 33 of the cooking chamber bottom wall 26 and ricochets off the bottom wall 26 at and near the back portion 33, creating a turbulent eddy. The turbulent airflow TF is directed generally toward a center of the cooking chamber 30 in the area of the food support 40 (FIG. 2). The horizontal air stream HF also picks up thermal energy in the section of back portion 33 of the cooking chamber bottom wall 26 not covered by the top firebox wall 90 so that the turbulent eddy TF includes air heated by the transfer of heat from the back portion of the cooking chamber bottom wall toward the center of the cooking chamber. The laminar airflow LF helps to pull the turbulent airflow TF toward the center of the cooking chamber 30 to evenly distribute heat throughout the cooking chamber, and in particular within central regions of the cooking chamber where the food is located. The laminar airflow LF at the front of the cooking chamber 30 intersects the generally horizontal airflow HF at the bottom of the cooking chamber 30 and is accelerated by the fan 160 and directed in the horizontal direction with the horizontal airflow HF to continue the airflow cycle within the cooking chamber. The generally horizontal airflow HF may also flow past the exhaust portals 64 in the side walls 16, 18 which can curtail or interrupt exhaust flow out of the oven 10 and reduce heat losses through the exhaust when the fan 160 is operating. Recycling heated air and smoke within the cooking chamber 30 can reduce operating costs as less heat is exhausted prematurely and less energy is consumed trying to heat "cold" spots within a stratified cooking chamber.

The fan 160 may operate continuously during the cooking process so that the heated air and smoke are continuously distributed within the cooking chamber 30. Alternatively, the fan 160 may operate on a timer so that it operates at discrete time intervals during the cooking process. In another example, the fan 160 may be configured to activate when a preselected temperature differential between the upper and lower portions of the cooking chamber 30 is measured by sensors (not shown) located in the cooking chamber. Other ways of operating the fan 160 of the air circulator 160 are within the scope of the invention. It will be understood that the fan 160 can be used with different types of foot supports (i.e., other than racks 42) and the entire system can be readily scaled up or down for ovens of different size.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. An oven for cooking food comprising:

a housing having a front, a back, a top, a bottom, and a cooking chamber in the housing sized and shaped for receiving the food to be cooked, the cooking chamber having a front, a back, an upper portion, and a lower portion;

a heating source for heating air in the housing;

a heating source chamber in the housing, the heating source being disposed in the heating source chamber, the heating source chamber including an outlet into the cooking chamber at the back of the housing for heated air to leave the heating source chamber and enter the cooking chamber;

a bottom wall defining the lower portion of the cooking chamber, a rising portion of the bottom wall extending upwardly and rearwardly toward the back of the housing;

the cooking chamber being configured to promote circulation of heated air from the heating source chamber outlet, along the back of the cooking chamber, forward to the front of the cooking chamber, downward along the front of the cooking chamber, and rearward and upward along the bottom wall;

an air mover mounted generally at the front of the housing located opposite the rising portion of the bottom wall for moving heated air in the cooking chamber, the air mover being arranged to move a stream of air rearward in the cooking chamber against the rising portion of the bottom wall, the circulation of heated air from the heating source chamber outlet intersecting and being accelerated by the stream of air directed by air mover against the portion of the bottom wall extending upwardly and rearwardly toward the back of the housing to produce turbulent air flow in the cooking chamber directed from the rising portion of the bottom wall generally toward a center of the cooking chamber, and thereby a more uniform temperature and heat distribution in the cooking chamber.

2. The oven as set forth in claim 1 wherein the bottom wall defines at least a portion of the heating source outlet.

3. The oven as set forth in claim 1 wherein the air mover is mounted on the bottom wall.

4. The oven as set forth in claim 3 wherein the air mover comprises a fan including a motor and a blade, the fan being mounted on the bottom wall such that the fan blade is disposed in the cooking chamber and the fan motor is disposed outside of the cooking chamber.

5. The oven as set forth in claim 4 further comprising a fan motor housing in the oven housing, the fan motor housing housing the fan motor and including a vent opening to an exterior of the oven.

6. The oven as set forth in claim 5 further comprising insulation in the fan motor housing to insulate the fan motor housing from the cooking and heating source chambers.

7. The oven as set forth in claim 1 wherein the cooking chamber 2*s* defined at an upper end of the cooking chamber by a curved back wall and a curved front wall, the curved front and back walls being arranged to promote circulation of heated air from the heating source chamber outlet, along the back of the cooking chamber, forward to the curved front wall of the cooking chamber to front in the cooking chamber, and downward along the front of the cooking chamber.

8. The oven as set forth in claim 7 further comprising an air mover in the heating source chamber.

9. The oven as set forth in claim 8 wherein the air mover at the front of the housing and the air mover of the heating source chamber are arranged to produce a continuous airflow cycle including the laminar airflow along the inner surface of the housing, the generally horizontal airflow at the lower portion of the cooking chamber, and the turbulent airflow generally at a center of the cooking chamber.

10. The oven as set forth in claim 1 wherein the housing further comprises a door in the front of the housing for placing food to be cooked in the cooking chamber and removing cooked food from the cooking chamber, the air mover being located below the door and at least partially within the cooking chamber.

11. The oven as set forth in claim 10 wherein the air mover comprises blades located in the cooking chamber and arranged centrally between opposing sides of the cooking chamber.

12. A barbeque oven for cooking food comprising:

a housing having a cooking chamber sized and shaped for receiving the food to be cooked, the cooking chamber having a front, a back, an upper portion and a lower portion, the housing further comprising a heating source chamber, a door opening in the front of the cooking chamber for placing flood to be cooked in the cooking chamber, and at least one door mounted on the housing for closing the door opening;

a heating source for heating air in the housing;

the heating source chamber including a fire chamber in the housing disposed below the cooking chamber, the heating source being disposed in the fire chamber, the heating source chamber further including an outlet into the cooking chamber at the back of the housing for heated air to leave the heating source chamber and enter the cooking chamber;

a wall in the housing located between the cooking chamber and the fire chamber, a rising portion of the wall extending upwardly and rearwardly toward the back of the housing;

the cooking chamber being configured to promote circulation of heated air from the heating source chamber outlet, along the back of the cooking chamber, forward to the front of the cooking chamber, downward along the front of the cooking chamber, and rearward and upward along the wall; and an air mover assembly arranged in the housing to produce an air stream in the cooking chamber flowing across the cooking chamber and impinging on the rising portion of the wall, the air mover assembly comprising an air mover positioned entirely below the door opening and above the heating source chamber, the circulation of heated air from the heating source chamber outlet intersecting and being accelerated by the air stream produced by air mover to produce turbulent air flow in the cooking chamber directed from the rising portion of the bottom wall generally toward a center of the cooking chamber, and thereby a more uniform temperature and heat distribution in the cooking chamber.

13. The barbeque oven as set forth in claim 12 wherein the fire chamber includes an outlet into the cooking chamber disposed at the rear of the cooking chamber, the air mover being arranged to direct the air stream toward the outlet.

14. The barbeque oven as set forth in claim 12 wherein the air mover is mounted on the wall.

15. The barbeque oven as set forth in claim 14 wherein the first air mover comprises a fan including a motor and a blade, the fan being mounted on the wall such that the fan blade is disposed in the cooking chamber and the fan motor is disposed outside of the cooking chamber.

16. The barbeque oven as set forth in claim 12 wherein the cooking chamber is defined at an upper end of the cooking chamber by a curved back wall and a curved front wall, the curved front and back walls being arranged to promote circulation of heated air from the heating source chamber outlet, up from back of the cooking chamber, forward to the curved front wall of the cooking chamber to front in the cooking chamber, and downward along the front of the cooking chamber, intersecting the airstream from the air mover to move rearward in the air stream from the air mover.

17. The barbeque oven as set forth in claim 12 wherein the air mover is arranged centrally between opposing sides of the cooking chamber.

18. The barbecue oven as set forth in claim 12 wherein the housing includes a first closure member on the front of the housing and movable between open and closed positions for accessing the cooking chamber, a second closure member on the front of the housing movable between open and closed positions for accessing the fire chamber, and a third closure member on the front of the housing and movable between open and closed positions for accessing the air mover assembly.

19. The barbecue oven as set forth in claim 18 wherein the heating source chamber further comprises a burner chamber, the housing further including a fourth closure member on the front of the housing and movable between open and closed positions for accessing the burner chamber.

20. The oven as set forth in claim 1 wherein the housing includes a first closure member on the front of the housing and movable between open and closed positions for accessing the cooking chamber, a second closure member on the front of the housing movable between open and closed positions for accessing the fire chamber, and a third closure member on the front of the housing and movable between open and closed positions for accessing the air mover assembly.

21. The oven as set forth in claim 20 wherein the heating source chamber further comprises a burner chamber, the housing further including a fourth closure member on the front of the housing and movable between open and closed positions for accessing the burner chamber.

* * * * *